US008062585B2

(12) United States Patent
Corazza et al.

(10) Patent No.: US 8,062,585 B2
(45) Date of Patent: Nov. 22, 2011

(54) MERCURY RELEASING METHOD

(75) Inventors: Alessio Corazza, Como (IT); Vincenzo Massaro, Albairate (IT); Alessandro Gallitognotta, Origgio (IT)

(73) Assignee: Saes Getters S.p.A., Lainate MI (IT)

( * ) Notice: Subject to any disclaimer, the term of this patent is extended or adjusted under 35 U.S.C. 154(b) by 160 days.

(21) Appl. No.: 12/373,414

(22) PCT Filed: Jun. 21, 2007

(86) PCT No.: PCT/IT2007/000442

§ 371 (c)(1),
(2), (4) Date: Jan. 12, 2009

(87) PCT Pub. No.: WO2008/007404

PCT Pub. Date: Jan. 17, 2008

(65) Prior Publication Data

US 2010/0001230 A1 Jan. 7, 2010

(30) Foreign Application Priority Data

Jul. 11, 2006 (IT) ..... MI2006A1344

(51) Int. Cl.

| | |
|---|---|
| ***C22C 1/00*** | (2006.01) |
| ***C22C 11/02*** | (2006.01) |
| ***C22C 21/06*** | (2006.01) |
| ***C22C 13/00*** | (2006.01) |
| ***H01J 7/18*** | (2006.01) |

(52) U.S. Cl. ..... 420/590; 420/526; 420/541; 420/557; 420/564; 252/181.3; 252/181.6; 252/181.7

(58) Field of Classification Search ..... 313/174, 313/490, 565; 252/181.6, 181.2, 181.1; 420/526, 420/590, 564, 557, 541; 75/327, 313
See application file for complete search history.

(56) References Cited

U.S. PATENT DOCUMENTS

| | | | | |
|---|---|---|---|---|
| 3,657,589 | A | 4/1972 | Della Porta et al. | |
| 4,107,565 | A * | 8/1978 | Isojima et al. | 313/565 |
| 4,278,908 | A | 7/1981 | Antonis | |
| 4,808,136 | A | 2/1989 | Schuster | |
| 4,823,047 | A | 4/1989 | Holmes et al. | |
| 5,061,442 | A * | 10/1991 | Ozimek | 420/526 |
| 5,520,560 | A | 5/1996 | Schiabel et al. | |
| 5,598,069 | A | 1/1997 | Van Os et al. | |
| 6,107,737 | A | 8/2000 | Della Porta | |
| 6,679,745 | B2 | 1/2004 | Santella et al. | |
| 6,680,571 | B1 | 1/2004 | Giorgi et al. | |

FOREIGN PATENT DOCUMENTS

| | | | |
|---|---|---|---|
| EP | 0 568 317 | A1 | 11/1993 |
| EP | 0 653 200 | A1 | 5/1995 |
| JP | 50 057166 | A | 5/1975 |
| WO | 94/18692 | A1 | 8/1994 |
| WO | 2006/030996 | A2 | 3/2006 |
| WO | WO2006030996 | * | 3/2006 |

* cited by examiner

*Primary Examiner* — Ling Choi
*Assistant Examiner* — Monique Peets
(74) *Attorney, Agent, or Firm* — Panitch Schwarze Belisario & Nadel LLP

(57) ABSTRACT

A method includes releasing mercury in devices requiring mercury, in particular fluorescent lamps. The method includes the use of manganese-mercury compositions.

17 Claims, 5 Drawing Sheets

Fig. 1(a)
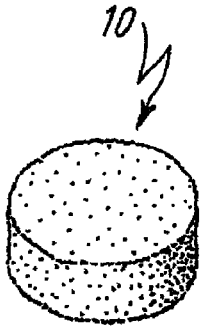
Fig. 1(b)
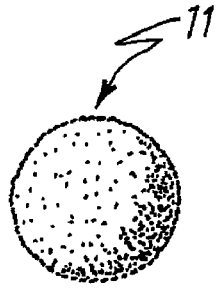
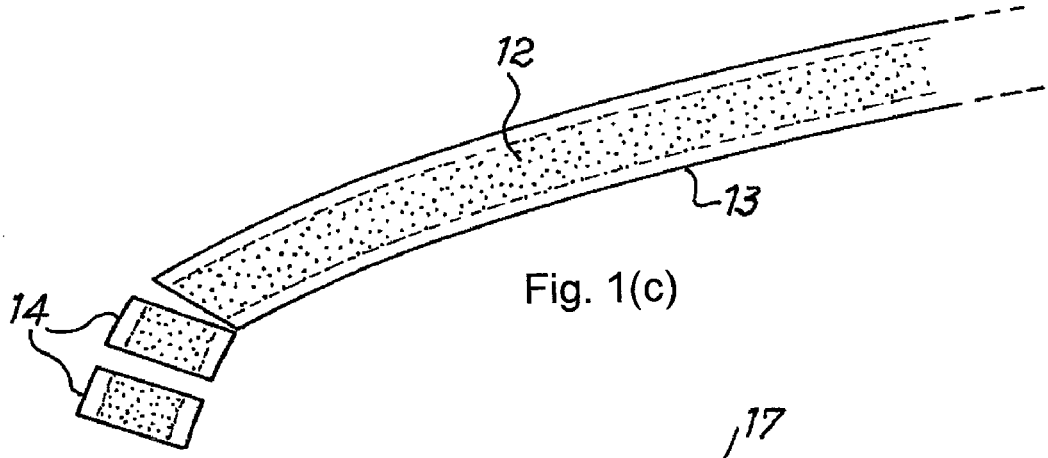
Fig. 1(c)
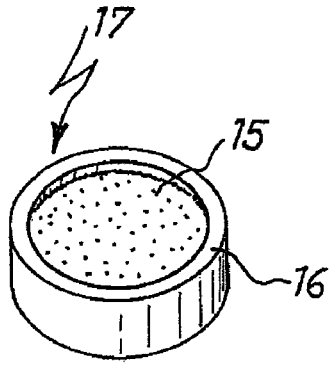
Fig. 1(d)

MERCURY RELEASING METHOD

CROSS-REFERENCE TO RELATED APPLICATIONS

This application is a Section 371 of International Application No. PCT/IT2007/000442, filed Jun. 21, 2007, which was published in the English language on Jan. 17, 2008, under International Publication No. WO 2008/007404 A2 and the disclosure of which is incorporated herein by reference.

BACKGROUND OF THE INVENTION

The present invention is directed to a method for releasing mercury.

Methods and systems for releasing mercury are used particularly in fluorescent lamps.

The method of dosing directly liquid mercury by means of syringe feeders is unable to provide an exact and reproducible dosage of the smaller and smaller amounts of the element which are required by the present lamps.

Some known methods are based on mechanical systems being loaded with metallic mercury. For example, U.S. Pat. Nos. 4,823,047 and 4,278,908 disclose capsules, made of metal or glass, respectively, containing liquid mercury, while U.S. Pat. No. 4,808,136 and European Patent Application Publication No. EP 568,317 disclose the use of porous pills or spherules (made of metallic or ceramic material, respectively), being impregnated with mercury which is then released by heating. However, also with these methods, the released amount of mercury is hardly reproducible and, mainly in the case of capsules, constructional problems may arise.

Other documents disclose the use of mercury compounds, such as U.S. Pat. No. 3,657,589 relating to Ti—Zr—Hg compounds (of particular importance being the compound $Ti_3Hg$) or U.S. Pat. No. 5,520,560 dealing with the use of compounds according to U.S. Pat. No. 3,657,589 in admixture with copper-tin alloys having functions of promoting the mercury release. However, these compounds require rather high temperatures for the mercury releasing, generally in excess of 500° C., whereby a specific high temperature thermal process is required in order to produce metallic mercury within the sealed lamp.

Finally, there is a great number of documents relating to amalgams being employed, such as International Patent Publication No. WO 94/18692 pertaining to amalgams with zinc or U.S. Pat. No. 5,598,069 pertaining to amalgams with indium-silver. However, the amalgams generally have a mercury content being not particularly important and above all they have a tendency to release mercury already at relatively low temperatures, e.g., about 100° C. The amalgams can thus lose amounts of mercury which are not negligible even during lamp manufacturing steps, which is undesirable, with possible pollution of the working environment. For example, the lamps may undergo heat treatments to enhance the removal of gaseous impurities being trapped in the phosphors without being yet cooled down to room temperature when the amalgam is introduced, thus starting to release mercury when the lamp is not yet sealed.

BRIEF SUMMARY OF THE INVENTION

An object of the present invention is to provide a method for dispensing mercury that overcomes at least some of the problems mentioned above.

This object is achieved with the present invention by employing manganese-mercury compositions containing between about 30% and 90.1% by weight of mercury.

Among the compositions useful to be employed in the method of the invention, of particular interest are the one comprising about 55% and the one comprising about 75% by weight of mercury.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 1(*a*) is a schematic perspective view of a pill-shaped embodiment of a mercury dispenser to be used in the method of the invention;

FIG. 1(*b*) is a schematic perspective view of a spherule-shaped embodiment of a mercury dispenser to be used in the method of the invention;

FIG. 1(*c*) is a schematic partial longitudinal view of a strip-shaped embodiment, of a mercury dispenser to be used in the method of the invention;

FIG. 1(*d*) is a schematic perspective view of a container-shaped embodiment of a mercury dispenser to be used in the method of the invention;

DETAILED DESCRIPTION OF THE INVENTION

The compositions of the invention comprise several forms of compounds formed of two elements. Mercury percentages of 78.5% and 90.1% by weight correspond to two actual intermetallic compounds, MnHg and $Mn_2Hg_5$, respectively, whereas the intermediate compositions can consist of mixtures between these compounds and possible amalgams.

These compositions can be obtained by reaction of the two metals in the desired weight ratio, e.g., at temperatures of about 500° C. during a time between 1 and 5 hours. The reaction is usually accomplished in a quartz vial, which for safety reasons can be contained in a reactor or steel housing. Mercury is used in liquid form, while manganese is used in powder form to enhance the contact between the two elements. The inside of the vial can be evacuated or filled with an inert gas. Manganese is preferably pre-treated by heating under vacuum, e.g., at 400° C. for 2 hours, in order to remove trapped gases which, during the reaction, could cause overpressures and breakages of the vial. As manganese is of lower density with respect to mercury, its loose powder floats on the mercury and during the reaction an interface of reacted material can result, which may be of hindrance to a further progress of the reaction. Therefore, it may be preferable to compress the manganese powders into a form of pills to be stacked in the vial until reaching the upper end thereof, whereby mercury can surround them along the whole length of the stack. At the end of the reaction, the vial is opened and a single, rather compact body, is withdrawn, which can be easily ground to obtain powders of the desired particle size, for example of less than half a millimeter.

The last step of the process for manufacturing the compositions according to the invention is a thermal treatment at about 60° C. under suction, such as with a vacuum of about $10^{-3}$ hectoPascal (hPa), in order to remove possible traces of non-reacted mercury which otherwise could evaporate at undesired stages of the lamp manufacturing process, or even earlier, during the storage of the composition, with a possible risk of pollution of the working environment.

The compositions of the invention have in practice no mercury emission until about 150° C., and consequently they can be introduced into lamps resulting from previous hot manufacturing steps without causing the element to be released. Mercury emission can then be caused to occur with a suitable activation treatment at temperatures between about 200 and 450° C.

Figure 3:
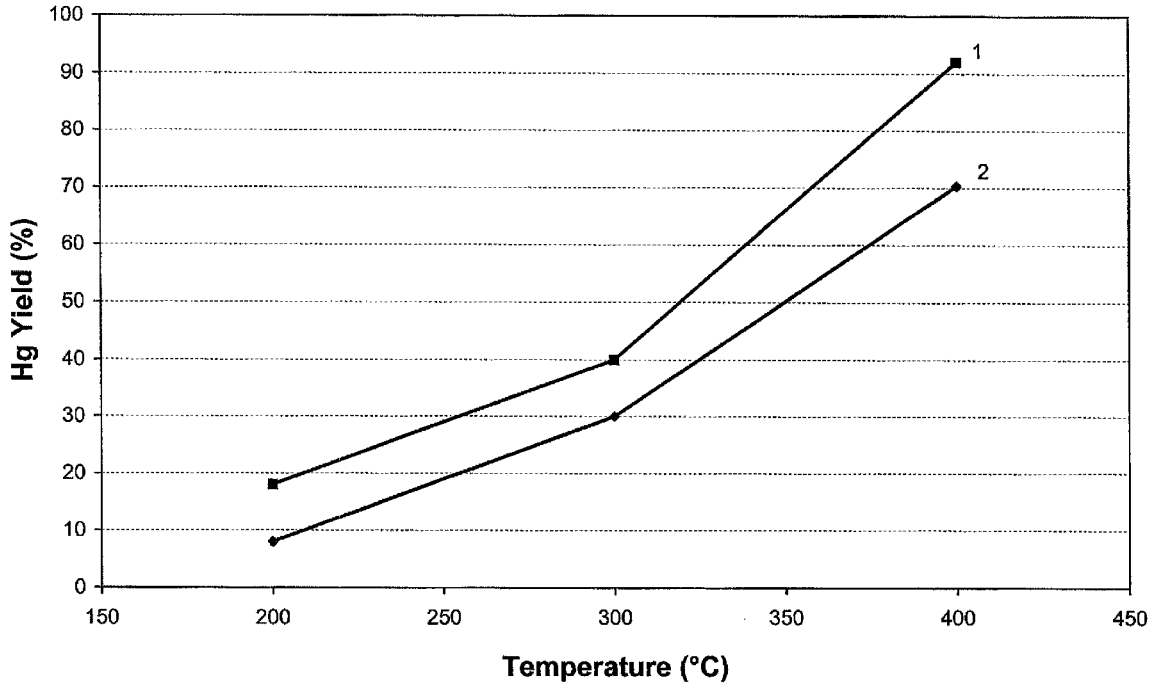
FIG. 3 is a graph which shows the mercury yield as a function of the temperature of two compositions according to the invention.

FIGS. 1(*a*)-1(*d*) are schematic views of some possible embodiments of mercury dispensers made with the compositions described in the foregoing. The dispensers can be produced to comprise only powders, the powders comprising an Mn—Hg composition, by, for example, compressing the powders to obtain a pill 10 (FIG. 1(*a*)) or a spherule 11 (FIG. 1(*b*)). Alternatively, it is possible to manufacture dispensers wherein the powders are supported, for example, by depositing powders 12 of the Mn—Hg compositions onto a metallic strip 13 and cutting from the strip lengths 14 to form single dispensers (FIG. 1(*c*)), or loading the powders 15 of Mn—Hg composition in an open container 16, thus obtaining the dispenser 17 (FIG. 1(*d*)). Other configurations, not shown in the drawings, are possible, such as the shields for cathode lamps carrying a track of a mercury releasing material as in U.S. Pat. No. 6,107,737, or the elongated bodies filled with powders of a mercury releasing material as in U.S. Pat. No. 6,679,745 B2 and as in U.S. Pat. No. 6,680,571 B1 (see in particular FIG. 3 of the latter patent).

The inventors have also ascertained that the presence of metallic tin in mechanical admixture with the powdered compositions is able to significantly increase the values of mercury yield of these compositions when the tin melting temperature is reached. The weight ratio between the Mn—Hg composition and tin can vary between about 4:1 and 1:9, with ratios of Mn—Hg/Sn higher than 4:1 having a tin quantity which is too small and the effect of yield increasing is obtained only in a fraction of the powders, thus giving rise to a mercury dispenser of non-homogeneous properties, whereas with ratios of less than 1:9, there is a tin excess, which involves the problem of low quantities of Hg available in the dispenser.

Figure 2:
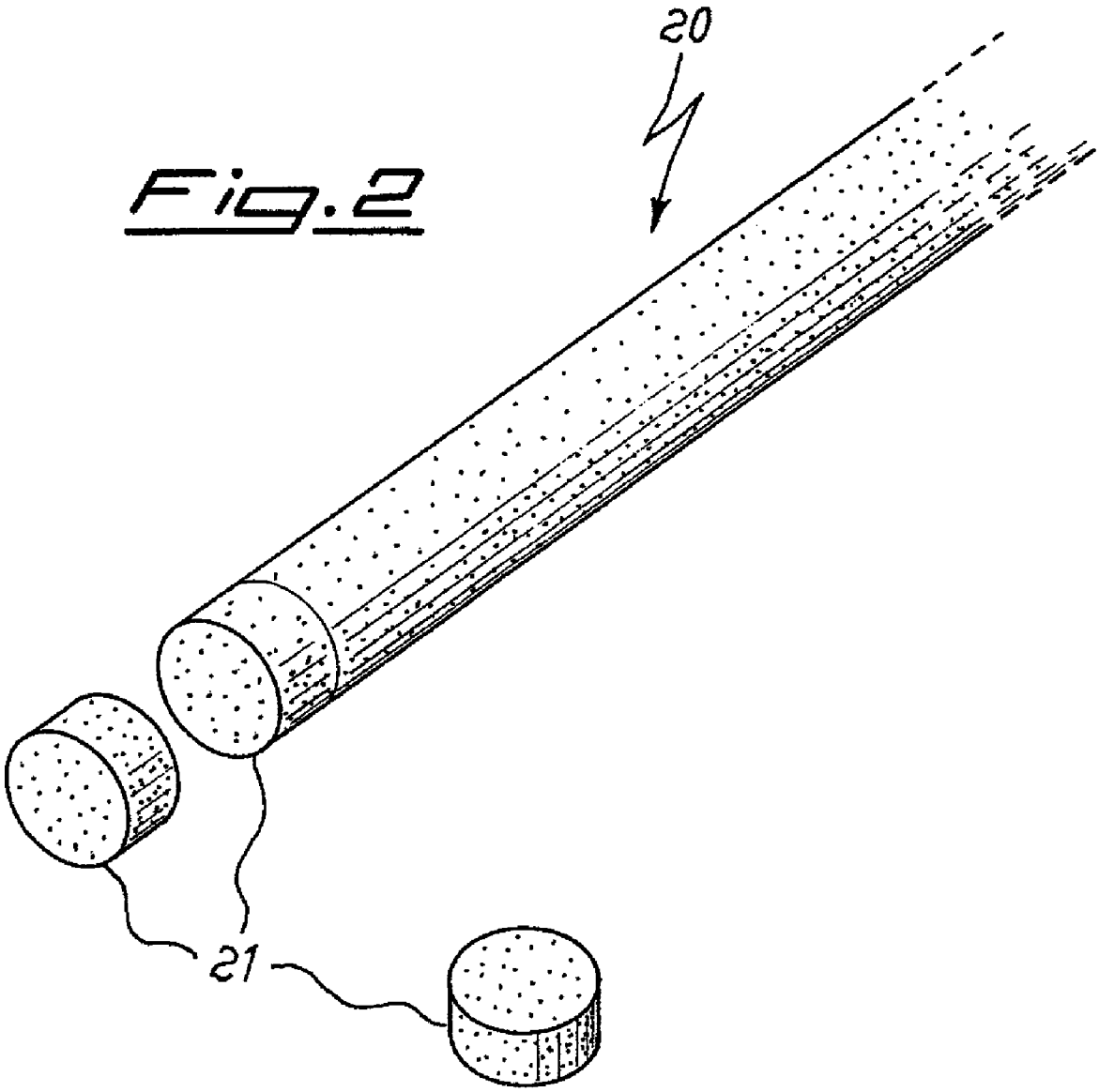
FIG. 2 is a schematic perspective partial longitudinal view of a semi-finished product from which mercury dispensers can be obtained, in which the Mn—Hg compositions are mixed with metallic tin.

The mixture between the chosen Mn—Hg composition and tin, taken in the desired weight ratio, can be formed in the shape of pills or spherules, such as by compression. It is, however, preferable to form bodies of the mixture by extruding the mixed powders of tin and of the Mn—Hg composition, exploiting the plasticity of tin which allows the formation of extruded bodies with good characteristics of mechanical strength. To ensure the mechanical properties of the system, in this embodiment the weight ratio of Mn—Hg/Sn is preferably lower than 2. FIG. 2 shows a possible embodiment of an extruded body. In FIG. 2, the body 20 has a circular cross-section (e.g., with a diameter between about 1 and 5 mm to obtain mercury dispensers for lamps) and indefinite length. From body 20 it is possible to obtain, by cutting, a series of dispensers 21, either immediately downstream of the extrusion or at the location where the lamps are manufactured. By operating correctly the linear loading of mercury, the body 20 is homogeneous throughout its whole length, so that by presetting the distance between two subsequent cuts, and consequently the length of dispensers 21, it is possible to ensure with good reproducibility the amount of mercury present in each dispenser.

The invention will be further described in the following examples.

EXAMPLE 1

This example concerns the production of a first Mn—Hg composition being useful in the method of the invention.

An open quartz vial, having inner volume of about 50 $cm^3$, is placed on the plate of a weighing scale. 15 g of liquid mercury are poured into the vial. Separately, 5 g of powdered manganese having a particle size of less than 60 μm, being previously subjected to a degassing treatment consisting of heating under vacuum at 400° C. during 2 hours, are weighed. The manganese powders are poured into the vial, which is then flame sealed. All the previous operations are carried out in a "glove-box" under atmosphere of argon. The closed vial is placed in an oven while subjecting the mixture to the following thermal cycle: temperature increasing up to 500° C. in half an hour, keeping this temperature for one hour, cooling to 200° C., keeping at this second temperature for 4 hours and finally natural cooling until reaching room temperature, which requires about 2 hours. At the end of this thermal treatment the vial is withdrawn from the oven and broken, thus extracting a pulverulent body which is ground to recover the particle size fraction of less than 50 μm. The powder thus selected undergoes a mild thermal treatment at 60° C. during 3 hours Sunder pumping to remove possible traces of non-reacted mercury.

EXAMPLE 2

This example is directed to the manufacturing of a second Mn—Hg composition which is useful in the method of the invention.

The same procedure of Example 1 is repeated, starting in this case from 11 g of mercury and 9 g of manganese.

EXAMPLE 3

This example concerns the measurement of the characteristics of mercury release from the powder obtained in Example 1.

With the powder of Example 1, three mercury dispensing devices are manufactured by loading for each dispenser 100 mg of powder into a cylindrical container of diameter 6 mm and height 1.5 mm (of the type shown in FIG. 1(*d*)), and compressing the powders in the container with a punch by applying a pressure of 700 $kg/cm^2$. The three dispensers thus obtained are commonly referred to as sample 1 in the following. Thermocouple wires are welded to each one of the three dispensers to detect the temperature during the subsequent treatment. The first dispenser of sample 1 is weighed, inserted into an evacuated glass bulb, induction heated from the outside of the bulb to 200° C. in 10 seconds, kept at this temperature during 20 seconds and finally let to cool down to room temperature. The bulb is then opened and the dispenser is weighed. By weight difference the mercury yield of the sample 1 at 200° C. is obtained (as a percentage with respect to the initially contained mercury). The procedure is repeated with the second and third dispensers, brought to 300 and 400° C. respectively. The three values of mercury yield thus obtained are graphically plotted in FIG. 3 as curve 1.

EXAMPLE 4

This example concerns the measuring of the characteristics of mercury release of the powder obtained in Example 2.

The test of Example 3 is repeated on sample 2, formed of three dispensers manufactured starting from powders of Example 2. The three values of mercury yield thus obtained are graphically plotted in FIG. 3 as curve 2.

EXAMPLE 5

This example concerns the measurements of characteristics of mercury release of a mixture between powders of tin and of the composition of Example 2.

Figure 4:
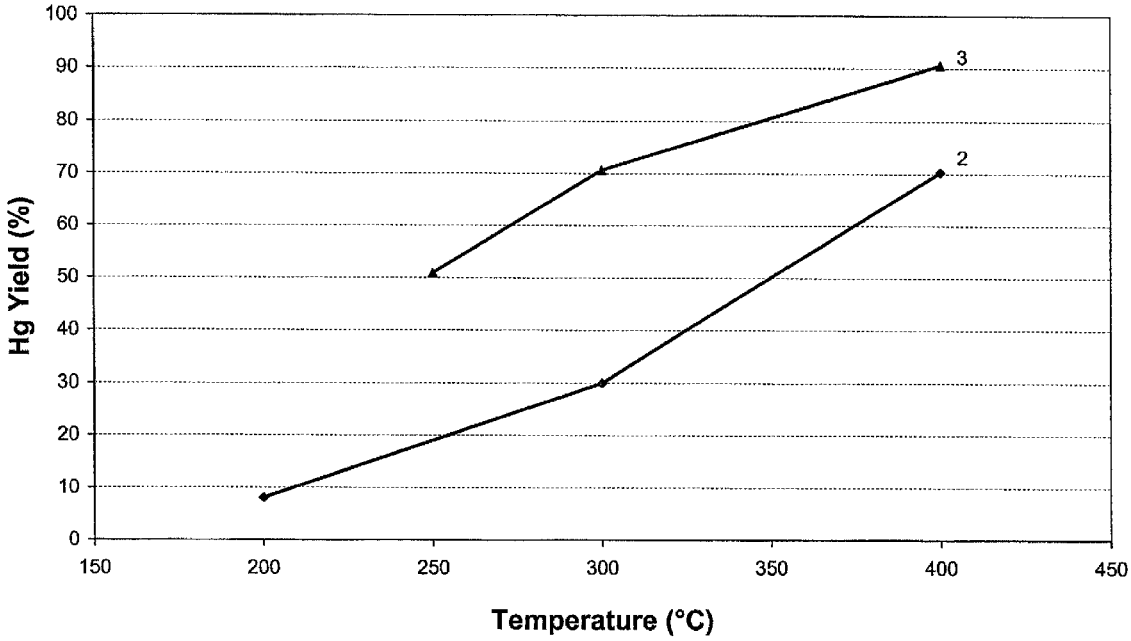
FIG. 4 is a graph which shows the mercury yield as a function of the temperature of a composition according to the invention being admixed with metallic tin.

Three mercury dispensers are produced following the procedure of Example 4, but employing a mixture formed of 60 mg of powder of manganese-mercury composition with 40 mg of tin powder with particle size lower than 150 μm. The three dispensers are brought to 250, 300 and 400° C., respectively. The three values of mercury yield are plotted, as curve 3, in FIG. 4 which for comparison reasons shows also the curve 2 of FIG. 3 (relating to the same manganese-mercury composition but without addition of tin).

EXAMPLE 6

This example concerns the measurements of characteristics of mercury release of a mixture between powders of tin and of the composition of Example 2, employing a longer activation time that is adopted in the manufacture of neon signs.

The test of Example 5 is repeated, with the following differences: the dispensers are loaded with a mixture formed of 50 mg of powder of the Mn—Hg composition of example 2 with 50 mg of tin powder with particle size lower than 150 μm; the three dispensers are brought to 260, 300 and 350° C., respectively; and, the activation is carried out by heating each dispenser at the test temperature in 10 seconds, keeping it at this temperature for 110 seconds and finally letting the dispenser to cool down to room temperature.

Figure 5:
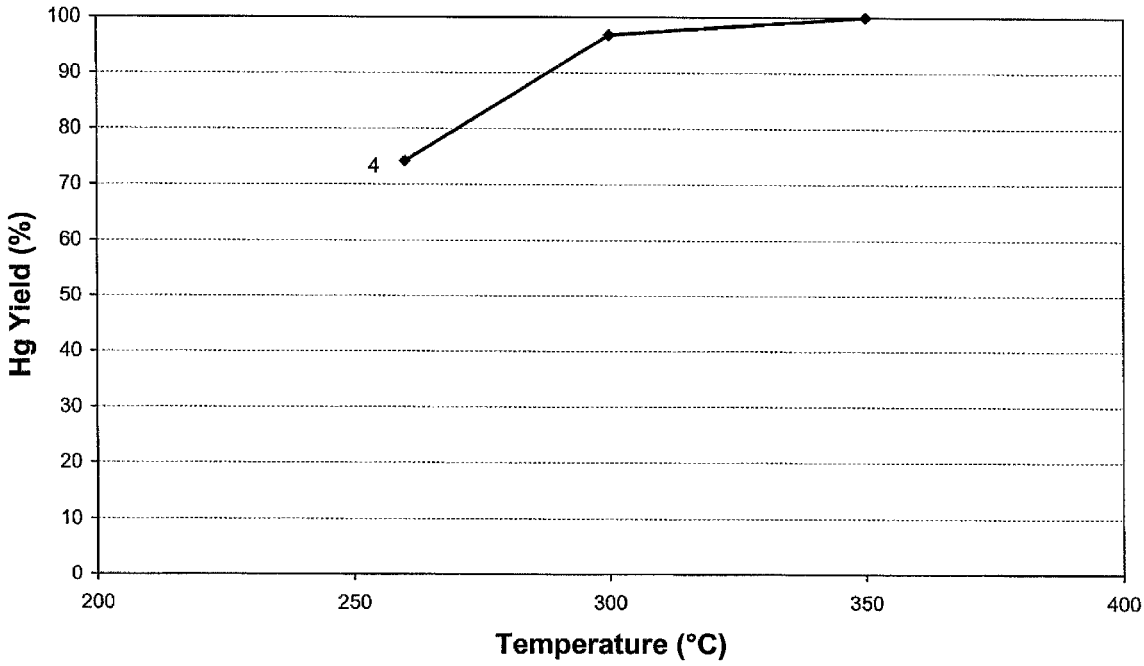
FIG. 5 is a graph which shows the mercury yield as a function of the temperature of a composition according to the invention, after a heating treatment of relatively long duration.

The three values of mercury yield are plotted, as curve 4, in FIG. 5.

As can be observed from the analysis of the results, the compositions of the invention show good characteristics of mercury yield in the range 200-400° C. In addition the mixtures with tin substantially increase the mercury yield.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method of releasing mercury, comprising heating a composition consisting of manganese and mercury, wherein the composition contains between about 30% and 90.1% by weight mercury, and wherein the heating is at a temperature between 200 and 450° C.

2. The method according to claim 1, wherein the composition contains about 55 weight % mercury.

3. The method according to claim 1, wherein the composition contains about 75 weight % mercury.

4. The method according to claim 1, wherein the composition is produced by a process comprising reacting manganese and mercury in a desired weight ratio inside a sealed reactor under vacuum or under an atmosphere of inert gas at a temperature of about 500° C. for 1 to 5 hours to form a reaction product, and subjecting the reaction product to a thermal treatment at about 60° C. under a reduced pressure for removing non-reacted mercury.

5. The method according to claim 4, wherein the production process further comprises degassing the manganese by heating the manganese under vacuum, and wherein the degassing occurs before the reacting the manganese and the mercury.

6. The method according to claim 5, wherein the heating of the manganese under vacuum takes place at 400° C. for 2 hours.

7. The method according to claim 4, wherein the manganese is employed in the production process in a form of loose powder.

8. The method according to claim 4, wherein the manganese is employed in the production process in a form of pills obtained by compression of manganese powder.

9. The method according to claim 4, wherein the production process further comprises grinding the reaction product to obtain a powder.

10. A method of releasing mercury, comprising heating a mixture of tin and a manganese-mercury composition containing between about 30% and 90.1% by weight of mercury, wherein the heating is at a temperature between 200 and 450° C.

11. The method according to claim 10, wherein both the manganese-mercury composition and the tin are in powder form.

12. The method according to claim 1, wherein the composition is dispensed in a form of a pill comprising a compressed powder of the manganese-mercury composition.

13. The method according to claim 1, wherein the composition is dispensed in a form of a spherule comprising a compressed powder of the manganese-mercury composition.

14. The method according to claim 1, wherein the composition is dispensed in a form of an elongated object comprising a deposit of powder of the manganese-mercury composition on a metallic strip.

15. The method according to claim 1, wherein the composition is dispensed from a mercury dispenser comprising an open container having loaded therein powder of the manganese-mercury composition.

16. The method according to claim 10, wherein the composition is dispensed from a mercury dispenser cut from a continuous body obtained by extrusion of a composition comprising tin and the manganese-mercury composition.

17. The method according to claim 10, wherein the weight ratio of the manganese-mercury composition to tin is between about 4:1 and 1:9.

* * * * *